US006339932B1

(12) United States Patent
Yamaguchi et al.

(10) Patent No.: US 6,339,932 B1
(45) Date of Patent: Jan. 22, 2002

(54) REFRIGERATING CYCLE USING CARBON DIOXIDE AS REFRIGERANT

(75) Inventors: Motohiro Yamaguchi, Hoi-gun; Toshinobu Takasaki, Chita; Shin Nishida, Mishima, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/644,330

(22) Filed: Aug. 23, 2000

(30) Foreign Application Priority Data

Aug. 23, 1999 (JP) ..... 11-235693

(51) Int. Cl.[7] ..... F25B 41/00

(52) U.S. Cl. ..... 62/114

(58) Field of Search ..... 62/114; 252/68

(56) References Cited

U.S. PATENT DOCUMENTS 5,804,096 A * 9/1998 Sato et al. ..... 252/68
5,966,949 A * 10/1999 Futagami et al. ..... 62/114
6,000,233 A * 12/1999 Nishida et al. ..... 62/114

* cited by examiner

*Primary Examiner*—William Doerrler
*Assistant Examiner*—Malik N. Drake
(74) *Attorney, Agent, or Firm*—Harness, Dickey & Pierce, PLC

(57) ABSTRACT

In an accumulator cycle, lubricating oil containing polyalkylene glycol (PAG) as a main component is used for a hermetic electric compressor. Lubricating oil mixed with refrigerant (carbon dioxide) can exhibit electric insulation resistance that causes no problems on a practical use. Since PAG has low compatibility with respect to carbon dioxide, a large amount of liquid phase refrigerant is difficult to be sucked into the compressor while being dissolved in lubricating oil. Therefore, the efficiency of the compressor is not lessened.

6 Claims, 2 Drawing Sheets

FIG. 1
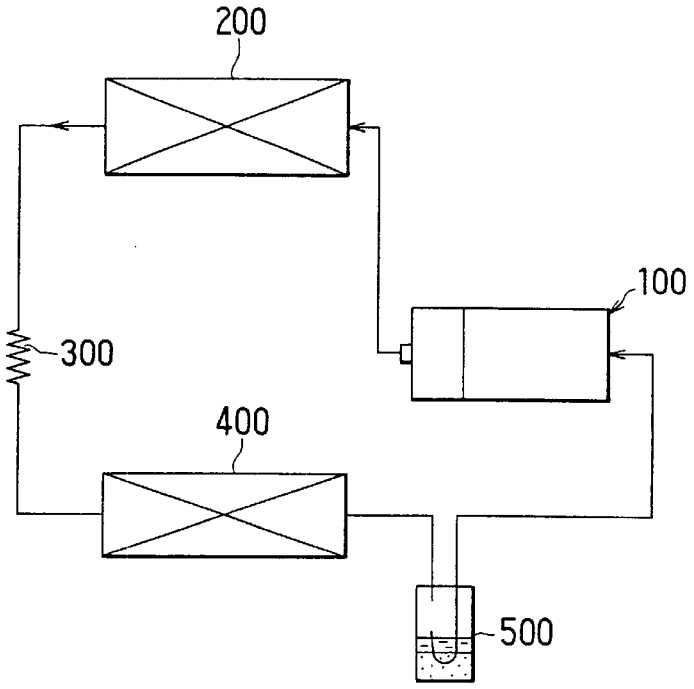
FIG. 3
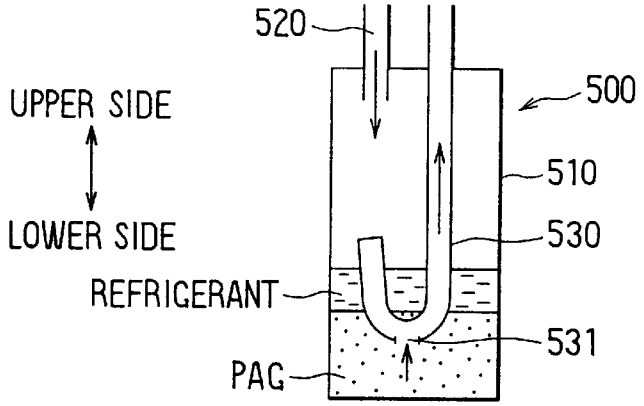
FIG. 4
ELECTRIC INSULATION RESISTANCE (MΩ)
| | LIQUID REFRIGERANT | REFRIGERANT + OIL | |
|---|---|---|---|
| | | PAG | POE |
| $CO_2$ | ∞ | ≧1000 | ∞ |
| 134a | 13 | ≒0 | 2.5 |

REFRIGERATING CYCLE USING CARBON DIOXIDE AS REFRIGERANT

CROSS REFERENCE TO RELATED APPLICATION

This application is based upon and claims the benefit of Japanese Patent Application No. 11-235693 filed on Aug. 23, 1999, the contents of which are incorporated herein by reference.

BACKGROUND OF THE INVENTION

1. Field of the Invention

This invention relates to a refrigerating cycle using carbon dioxide as refrigerant.

2. Description of the Related Art

Lubricating oil (refrigerating machine oil) for a compressor in a refrigerating cycle is generally mixed with refrigerant to be supplied to a sliding part in the compressor. Polyalkylene glycol (PAG) and polyol ester (POE) are widely known as lubricating oil for the refrigerating cycle using, as refrigerant, flon such as 134*a*.

In a hermetic electric compressor driven by an electric motor, refrigerant must be introduced into a housing of the electric motor for cooling the electric motor. This compressor is difficult to use PAG as lubricating oil because PAG mixed with 134*a* (flon) has extremely small electric insulation resistance. Therefore, when the refrigerating cycle using 134*a* (flon) as refrigerant includes such a hermetic electric compressor, generally, POE having electric insulation resistance larger than that of PAG is used as lubricating oil. Incidentally, PAG is generally used in a refrigerating cycle equipped with an open type compressor which is provided separately from a driving device such as an electric motor.

On the other hand, a kind of refrigerating cycle uses carbon dioxide as refrigerant and includes an accumulator for separating lubricating oil from refrigerant discharged from an evaporator and for supplying the separated lubricating oil to a suction side of a compressor together with gaseous phase refrigerant. This kind of refrigerating cycle is referred to as an accumulator cycle below. When POE having high compatibility relative to carbon dioxide is used as lubricating oil in the accumulator cycle, a large amount of liquid phase refrigerant that is dissolved in lubricating oil can be sucked into the hermetic electric compressor together with lubricating oil. Accordingly, the hermetic electric compressor is brought into a liquid compressed state, and the efficiency of the compressor is lessened.

SUMMARY OF THE INVENTION

The present invention has been made in view of the above problems. An object of the present invention is to provide an accumulator cycle including a hermetic electric compressor, which can prevent efficiency of the compressor from being lessened.

According to the present invention, in a refrigerating cycle using carbon dioxide as refrigerant, lubricating oil for a hermetic electric compressor contains as a main component one of polyalkylene glycol (PAG) and poly (vinyl ether) (PVE).

Accordingly, in state where lubricating oil is mixed with refrigerant (carbon dioxide), the lubricating oil can exhibit high electric insulation resistance that causes no problems on a practical use. Further, since lubricating oil can have lower compatibility with respect to carbon dioxide than POE, a large amount of liquid phase refrigerant is very difficult to be sucked into the compressor while being dissolved in lubricating oil. Therefore, the efficiency of the compressor is not lessened.

BRIEF DESCRIPTION OF THE DRAWINGS

Other objects and features of the present invention will become more readily apparent from a better understanding of the preferred embodiments described below with reference to the following drawings, in which;

FIG. 1 is a schematic diagram showing an accumulator cycle in preferred embodiments according to the present invention;

FIG. 3 is a schematic view showing an accumulator used in the accumulator cycle; and FIG. 4 is a table indicating values of electric insulation resistances of refrigerant and lubricating oil.

Figure 2:
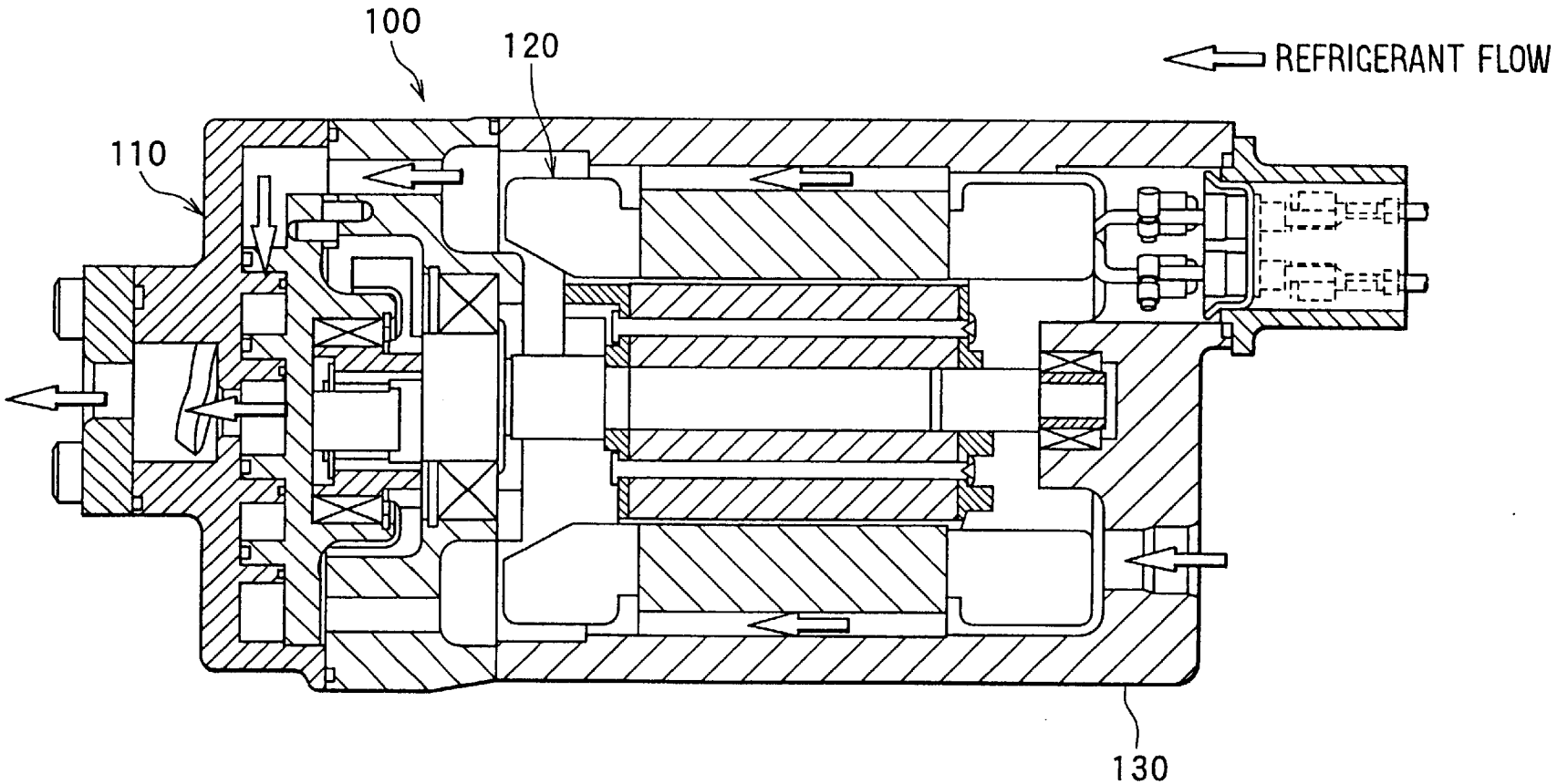
FIG. 2 is a cross-sectional view showing a hermetic electric compressor used in the accumulator cycle.

DETAILED DESCRIPTION OF THE PREFERRED EMBODIMENTS (First Embodiment)

A refrigerating cycle according to the present invention is applied to an accumulator cycle using carbon dioxide as refrigerant.

Referring to FIG. 1, the accumulator cycle includes a hermetic electric compressor 100 for sucking and compressing refrigerant (carbon dioxide). The compressor 100 is, as shown in FIG. 2, composed of a scroll type compressing unit 110, and an electric motor 120 for driving the compressing unit 110. Refrigerant enters a motor housing 130 of the electric motor 120 from one end side in an axial direction of the motor housing 130, cools the electric motor 120, and then is sucked into and compressed in the compressor unit 110 that is provided at the other end side in the axial direction of the motor housing 130.

Further, in FIG. 1, a radiator (gas cooler) 200 performs heat exchange between air and high-temperature and high-pressure refrigerant discharged from the compressor 100, and a pressure-reducing unit 300 decompresses refrigerant discharged from the radiator 200. The pressure-reducing unit 300 is a fixed aperture type, which has a fixed opening degree, such as a capillary tube. An evaporator 400 then evaporates refrigerant decompressed by the pressure-reducing unit 300, which thus exhibits a refrigerating capability. Further, an accumulator 500 receives refrigerant from the evaporator 400 and divides the refrigerant into liquid phase refrigerant and gaseous phase refrigerant. The accumulator 500 further separates lubricating oil for the compressor 100 from refrigerant. The separated gaseous phase refrigerant and lubricating oil are conducted from the accumulator 500 toward the suction side of the compressor 100.

As shown in FIG. 3, the accumulator 500 is composed of a generally columnar accumulator housing 510, a refrigerant inlet 520 provides at an upper side of the housing 510, and a refrigerant discharge pipe 530 formed into a J-shape projecting downward and convexly. One end of the refrigerant discharge pipe 530 is positioned at an upper side of a liquid surface of liquid phase refrigerant accumulated in the housing 510, and open at a lower side of the refrigerant inlet 520 for conducting gaseous phase refrigerant to the suction side of the compressor 100 through the refrigerant discharge pipe 530. The refrigerant discharge pipe 530 further has a lubricating oil suction port 531 at the lower end thereof for sucking lubricating oil accumulated at the lower side of liquid phase refrigerant. The lubricating oil separated by and accumulated in the accumulator 500 is sucked into the compressor 100 together with the gaseous phase refrigerant flowing in the refrigerant discharge pipe 530.

Here, in the present embodiment, oil containing polyalkylene glycol (PAG) as a main component is used as lubricating oil (refrigerating machine oil). Here, it should be noted that the content of the main component in oil may be 100%.

Next, effects and features of the present embodiment are described. As described above, PAG has extremely small electric insulation resistance. As opposed to this, carbon dioxide is generally insulating material. Therefore, PAG mixed with carbon dioxide can exhibit, as shown in FIG. 4, electric insulation resistance of 1 GΩ or more, thereby securing electric insulation resistance that causes no problems on a practical use. That is, since carbon dioxide has extremely large electric insulation resistance, lubricating oil mixed with refrigerant (carbon dioxide) can exhibit a sufficient magnitude of the electric insulation resistance encountering no problems on a practical use regardless of the magnitude of the electric insulation resistance of the lubricating oil.

PAG has low compatibility relative to carbon dioxide as compared to POE, it is difficult that a large amount of liquid refrigerant dissolved in lubricating oil is sucked into the compressor 100 together with lubricating oil. Therefore, the efficiency of the compressor 100 is prevented from being lessened. Thus, according to the present embodiment, the efficiency of the compressor can be prevented from being lessened while securing the electric insulation resistance that causes no problems on a practical use.

Incidentally, in case where the accumulator cycle in the present embodiment works to remove heat at a heating operation, there is a possibility that the density of liquid phase refrigerant exceeds the density of lubricating oil when the temperature of refrigerant is lowered excessively (for instance, to about −35° C. to −40° C.) at the side of the evaporator 400. Liquid phase refrigerant having the density larger than that of lubricating oil may move downward to be sucked into the lubricating oil suction port 531 in the accumulator 500.

To prevent this problem, in the present embodiment, various kinds of additives are added to PAG to increase the density of lubricating oil so that the density of liquid phase refrigerant does not exceed the density of lubricating oil even at low temperature of −35° C. to −40° C. Specifically, the density of lubricating oil must be increased to be larger than 1115 kg/m$^3$ at −35° C. to −40° C. that is the density of refrigerant (carbon dioxide) at −35° C. to −40° C.

(Second Embodiment)

A second preferred embodiment adopts oil containing poly(vinyl ether) (PVE) as a main component of lubricating oil. The compatibility of PVE is higher than that of PAG, but sufficiently lower than that of POE. Therefore, PVE can exhibit properties as effective as those of PAG. Here, it should be noted that a content of the main component in oil may be 100%.

(Third Embodiment)

In a third preferred embodiment, lubricating oil can be supplied to the compressor 100 even in state where temperature of refrigerant is lowered excessively. Specifically, oil containing PAG or PVE as a main component is mixed with oil (POE in the present embodiment) having compatibility higher than that of the main component. The compatibility of lubricating oil can be secured at an appropriate level while being prevented from being increased excessively, by mixing lubricating oil with an appropriate amount of POE or the like having high compatibility.

Accordingly, even when the temperature of refrigerant is lowered excessively so that liquid phase refrigerant is easily sucked into the compressor 100, since lubricating oil have compatibility, the lubricating oil is supplied into the compressor 100 together with liquid phase refrigerant. Thus, even in case where the supply amount of lubricating oil is liable to be deceased due to excessive fall in temperature of refrigerant and the like, a sufficient amount of lubricating oil can be supplied into the compressor 100.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A refrigerating cycle comprising:

a hermetic electric compressor for sucking and compressing refrigerant therein, the hermetic electric compressor including a hermetic housing holding an electric motor in which the refrigerant flows, the refrigerant being composed of carbon dioxide;

a radiator for cooling the refrigerant discharged from the hermetic electric compressor;

a pressure-reducing unit for decompressing the refrigerant discharged from the radiator;

an evaporator for evaporating the refrigerant decompressed by the pressure-reducing unit; and an accumulator for separating the refrigerant discharged from the evaporator into a liquid phase refrigerant and a gaseous phase refrigerant while separating a lubricating oil for the compressor from the refrigerant, and for conducting the gaseous phase refrigerant and the lubricating oil toward the hermetic electric compressor, wherein the lubricating oil contains polyalkylene glycol as a main component.

2. The refrigerating cycle of claim 1, wherein the lubricating oil contains oil having higher compatibility with respect to carbon dioxide than that of polyaklylen glycol.

3. The refrigerating cycle of claim 1, wherein the lubricating oil contains polyol ester.

4. A refrigerating cycle comprising:

a hermetic electric compressor for sucking and compressing refrigerant therein, the hermetic electric compressor including a hermetic housing holding an electric motor in which the refrigerant flows, the refrigerant being composed of carbon dioxide;

a radiator for cooling the refrigerant discharged from the hermetic electric compressor;

a pressure-reducing unit for decompressing the refrigerant discharged from the radiator;

an evaporator for evaporating the refrigerant decompressed by the pressure-reducing unit; and an accumulator for separating the refrigerant discharged from the evaporator into a liquid phase refrigerant and a gaseous phase refrigerant while separating a lubricating oil for the compressor from the refrigerant, and for conducting the gaseous phase refrigerant and the lubricating oil toward the hermetic electric compressor, wherein the lubricating oil contains poly (vinyl ether) as a main component.

5. The refrigerating cycle of claim 4, wherein the lubricating oil contains oil having higher compatibility with respect to carbon dioxide than that of poly (vinyl ether).

6. The refrigerating cycle of claim 4, wherein the lubricating oil contains polyol ester.

* * * * *